US008657511B2

(12) United States Patent
Kim et al.

(10) Patent No.: US 8,657,511 B2
(45) Date of Patent: Feb. 25, 2014

(54) IMAGE FORMING APPARATUS

(75) Inventors: Tae Han Kim, Seongnam-si (KR); Byung Hee Cho, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 560 days.

(21) Appl. No.: 12/647,227

(22) Filed: Dec. 24, 2009

(65) Prior Publication Data

US 2010/0172685 A1 Jul. 8, 2010

(30) Foreign Application Priority Data

Jan. 6, 2009 (KR) ..... 10-2009-0000711

(51) Int. Cl.
*B41J 13/10* (2006.01)
*B65H 1/04* (2006.01)

(52) U.S. Cl.
USPC ..... 400/578; 347/104; 271/145; 271/171

(58) Field of Classification Search
USPC ..... 400/578
See application file for complete search history.

(56) References Cited

U.S. PATENT DOCUMENTS 4,032,136 A * 6/1977 Komaba et al. ..... 271/160
4,280,692 A * 7/1981 Hutchinson et al. ..... 271/160
4,786,042 A * 11/1988 Stemmle ..... 271/9.1
5,046,714 A * 9/1991 Hwang ..... 271/162
5,931,456 A * 8/1999 Laidlaw ..... 271/171
6,826,383 B2 * 11/2004 Yano ..... 271/171
7,036,816 B2 * 5/2006 Abe ..... 271/171
7,648,134 B2 * 1/2010 Lim ..... 271/118
7,862,036 B2 * 1/2011 Rowe et al. ..... 271/171
2005/0269764 A1 * 12/2005 Lee et al. ..... 271/171
2009/0072471 A1 * 3/2009 Rowe et al. ..... 271/171

FOREIGN PATENT DOCUMENTS

JP 08-290836 11/1996

OTHER PUBLICATIONS

English language abstract of JP 08-290836, published Nov. 5, 1996.
Machine English language translation of JP 08-290836, published Nov. 5, 1996.

* cited by examiner

*Primary Examiner* — Jill Culler
(74) *Attorney, Agent, or Firm* — Stanzione & Kim, LLP

(57) ABSTRACT

Disclosed is an image forming apparatus and printing media cassette thereof. The loading position of a loading plate of the printing media cassette can be varied based on the printing medium size by a capacity adjustment unit. The capacity adjustment unit may operate in association with the size adjustment guide so as to define the loading position based on the size of the printing media. The image forming apparatus can include the printing media cassette detachably received in the body thereof.

17 Claims, 9 Drawing Sheets

IMAGE FORMING APPARATUS

CROSS-REFERENCE TO RELATED APPLICATION(S)

This application claims the benefit of Korean Patent Application No. 2009-0000711, filed on Jan. 14, 2009 in the Korean Intellectual Property Office, the disclosure of which is incorporated herein by reference in its entirety.

TECHNICAL FIELD

The present disclosure generally relates to an image forming apparatus, and, more particularly, to an image forming apparatus having an improved paper supply cassette with a variable loading capacity.

BACKGROUND OF RELATED ART

Image forming apparatuses can be used to print an image on a printing medium, such as paper, for example, based on input image signals. Examples of image forming apparatuses include printers, copiers, facsimiles and so-called multifunctional apparatuses that combine some of the functionalities of the aforementioned apparatuses.

An image forming apparatus can use various image formation methods including, for example, an electro-photographic method and an inkjet method. In such methods, toner or ink can adhere to paper to form a visible image on the paper. The image forming apparatus includes a paper supply unit to supply paper, a printing unit to apply toner or ink to the paper to form an image in accordance with the image formation method being used, and a paper discharge unit to discharge the paper on which the image is printed to the outside.

More particularly, the paper supply unit can be a paper supply cassette, which includes a paper loading plate on which paper to be supplied is loaded, and a lifting device to move the paper loading plate upward toward a pickup roller. The paper loaded on the paper loading plate is picked up one sheet at a time via the pickup roller to be delivered to the printing unit.

To allow the pickup roller to continuously pick up the paper loaded on the paper loading plate when using the lifting device, it may be necessary to increase the distance that the paper loading plate moves upwards as the amount of the paper loaded on the paper loading plate is reduced. The lifting device can be realized in such a manner that the paper loading plate is moved up and down using a motor or an elastic force, e.g., of a spring.

SUMMARY OF THE DISCLOSURE

In accordance with one aspect of the disclosure, there is provided an image forming apparatus that may include a body having an opening and a printing media cassette receivable into the body through the opening. The printing media cassette may comprise a printing media loading plate and a capacity adjustment unit. The printing media loading plate may have a surface on which to support printing media received in the printing media cassette, and may be configured to move into varying positions so as to define varying amounts of the printing media that can be received in the printing media cassette. The capacity adjustment unit may be configured to restrict a movement of the printing media loading plate to define a loading position of the printing media loading plate. The loading position of the printing media loading plate may be one of the varying positions selected based on a size of the printing media being received in the printing media cassette.

The capacity adjustment unit may comprise a guide member and a locking member. The guide member may be movable to define an area on the surface of the printing media loading plate variably based on the size of the printing media being received in the printing media cassette. The locking member may be configured to move in association with the guide member to thereby hold the printing media loading plate at the selected loading position.

The locking member may include a plurality of restrainers. The printing media loading plate may include a holder that may be configured to engage with a select one of the plurality of restrainers based on the size of the printing media.

The plurality of restrainers may include a first restrainer and a second restrainer spaced apart from each other.

The first and second restrainers may each comprise a protrusion extending from the locking member toward the holder of the printing media loading plate. One of the first and second restrainers may protrude further than the other.

One of the first and second restrainers that protrudes further may be movably and elastically supported on the locking member.

The printing media cassette may further comprise an elastic member and a stopper. The elastic member may be arranged to elastically bias the locking member toward a first direction. The stopper may be positioned to come into an interfering contact with a portion of the locking member to limit the movement of the locking member in the first direction so as to maintain the locking member at a first position at which the locking member holds the printing media loading plate at a first one of varying positions as the selected loading position.

The locking member may further comprise an end portion thereof that is configured to come into a pressing contact with a portion of the body when the printing media cassette is received in the body. The pressing contact between the end portion of the locking member and the portion of the body may cause the locking member to move in a second direction opposite the first direction.

The locking member may include an operating rib that extends from the locking member. The guide member may include a press portion configured to come into a pressing contact with the operating rib of the locking member so as to cause the locking member to move in a second direction opposite the first direction from the first position to a second position at which the locking member holds the printing media loading plate at a second one of varying positions as the selected loading position.

The press portion of the guide member may be configured to come into the pressing contact with the operating rib selectively based on the size of the printing media.

The image forming apparatus may further comprise an elastic member to elastically bias the printing media loading plate in an upward direction.

According to another aspect of the present disclosure, there may be provided a printing media cassette for receiving therein printing media for use by an image forming apparatus. The printing media cassette may comprise a printing media loading plate and a capacity adjustment unit. The printing media loading plate may have a surface on which to support the printing media received in the printing media cassette, and may be configured to move into varying positions so as to define varying amounts of the printing media that can be received in the printing media cassette. The capacity adjustment unit may be configured to restrict a movement of the printing media loading plate to define a loading position of the printing media loading plate, which may be one of the varying positions selected based on a size of the printing media being received in the printing media cassette.

According to yet another aspect of the present disclosure, a printing media cassette for receiving therein printing media for use by an image forming apparatus may be provided to comprise a printing media loading plate, a guide member and a locking member. The printing media loading plate may have a surface on which to support the printing media received in the printing media cassette, and may be configured to move between at least a first loading position and a second loading position to define a first loading capacity and a second loading capacity, respectively, of the printing media that can be received in the printing media cassette. The guide member movable between at least a first guide position and a second guide position at which to guide movement of printing media of a first size and printing media of a second size, respectively. The locking member may be moveable in association with the guide member such that the locking member causes the printing media loading plate to be in the first loading position when the guide member is in the first guide position and to be in the second loading position when the guide member is in the second guide position.

The first size may comprise for example an A-4 size. The second size may comprise for example an A-5 size. The first loading capacity may be greater than the second loading capacity.

The first size may alternatively comprise for example a Letter size. The second size may alternatively comprise for example an A-5 size. The first loading capacity may be greater than the second loading capacity.

The locking member may comprise first and second protrusions, one of which may protrude further than the other. The printing media loading plate may include a holder member extending from the surface of the printing media loading plate toward the first and second protrusions of the locking member so as to selectively engage one of the first and second protrusions. The guide member may comprise a press portion that is arranged to come onto pressing contact with the locking member to thereby cause the locking member to move in a first direction between a first locking position at which the holder member of the printing media loading plate is engaged with the first protrusion of the locking member and a second locking position at which the holder member of the printing media loading plate is engaged with the second protrusion of the locking member.

The printing media cassette may further comprise an elastic member that may be disposed in contact with the locking member and that may elastically bias the locking member toward a second direction opposite the first direction.

The printing media cassette may further comprise a cassette body supporting thereon each of the printing media loading plate and the locking member. The cassette body may comprise a stopper member arranged and position to come into pressing contact with the locking member so as to limit the movement of the locking member in the second direction.

The locking member may further comprise an end portion thereof that protrudes out of the cassette body and that when pressed causes the locking member to move in the first direction so as to be retracted into the cassette body.

BRIEF DESCRIPTION OF THE DRAWINGS

Various aspects and advantages of the present disclosure will become apparent and more readily appreciated from the following description of several embodiments thereof, taken in conjunction with the accompanying drawings, in which.

DETAILED DESCRIPTION OF SEVERAL EMBODIMENTS

Figure 1:
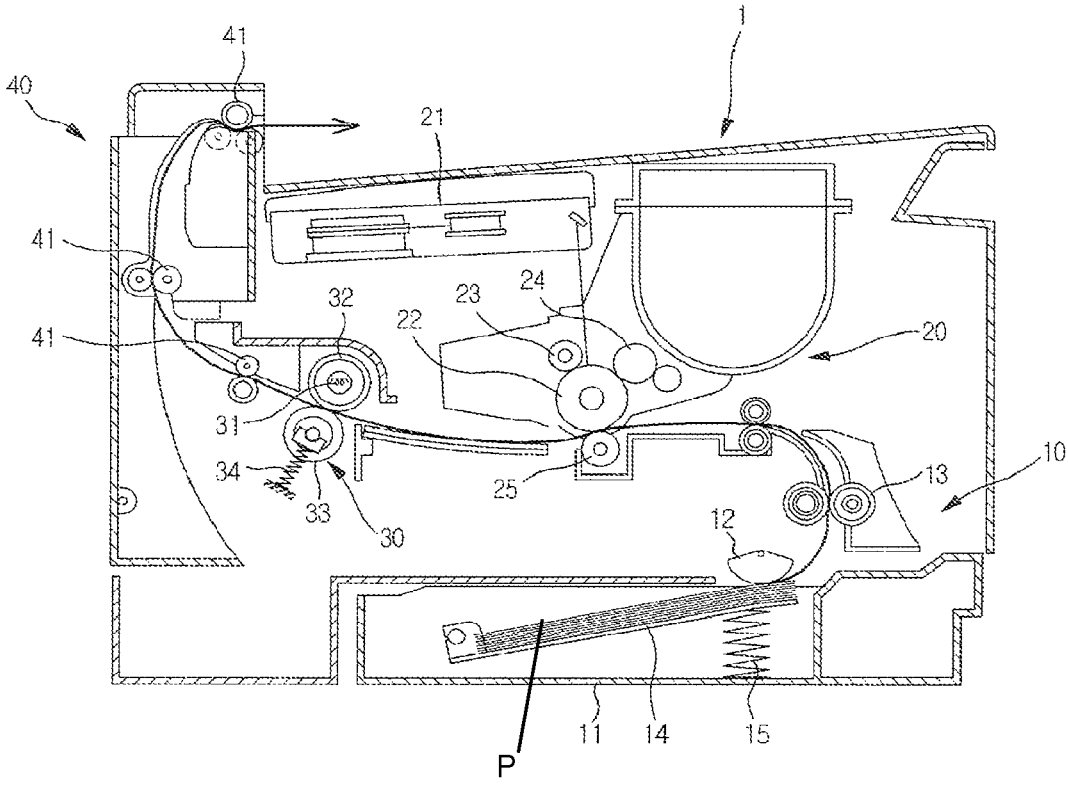
FIG. 1 is a view illustrating the configuration of an image forming apparatus, according to an embodiment.

Reference will now be made in detail to several embodiments, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a view illustrating an image forming apparatus according to an embodiment.

As shown in FIG. 1, the image forming apparatus according to an embodiment can include a body 1 configured to define an overall exterior appearance of the image forming apparatus and to support various elements of the image forming apparatus, a paper supply device 10 configured to supply paper P, a developer 20 configured to develop an image on the paper, a fusing device 30 configured to fix the developed image to the paper by applying heat and pressure to the paper and a paper discharging device 40 configured to discharge the paper having the printed image to a space outside of the body 1.

The paper supply device 10 can include a paper supply cassette 11 in which printing media, such as the paper P, can be stored, a pickup roller 12 configured to pick up the paper P stored in the paper supply cassette 11 one sheet at a time and delivery rollers 13 configured to deliver the picked-up paper to the developer 20. The paper supply cassette 11 can be detachably coupled to the body 1. The body 1 can define an opening (not shown), for example, at a lower front end surface thereof, through which the paper supply cassette 11 may be received into the body 1.

The developer 20 can include a photosensitive drum 22 having a surface on which an electrostatic latent image can be formed by being exposed to a light received from a laser scanning unit 21, a charging roller 23 configured to charge the photosensitive drum 22, a developing roller 24 configured to develop the electrostatic latent image formed on the photosensitive drum 22 into a toner image and a transfer roller 25 configured to press the paper to the photosensitive drum 22 so as to transfer the toner image of the photosensitive drum 22 to the paper.

The fusing device 30 can be configured to fix the toner image to the paper by applying heat and pressure to the paper. The fusing device 30 can include a heating roller 32 containing a heater 31 configured to apply heat to the paper to which the toner image has been transferred, a press roller 33 arranged opposite the heating roller 32 and adapted to keep a constant fusing pressure between the press roller 33 and the heating roller 32 and a press member 34 configured to elastically bias the press roller 33 to allow the press roller 33 to come into close contact with the heating roller 32.

The paper discharging device 40 can include multiple paper discharge rollers 41 successively arranged to discharge the paper to a space outside of the body 1 after the paper has passed through the fuser 30.

Figure 2:
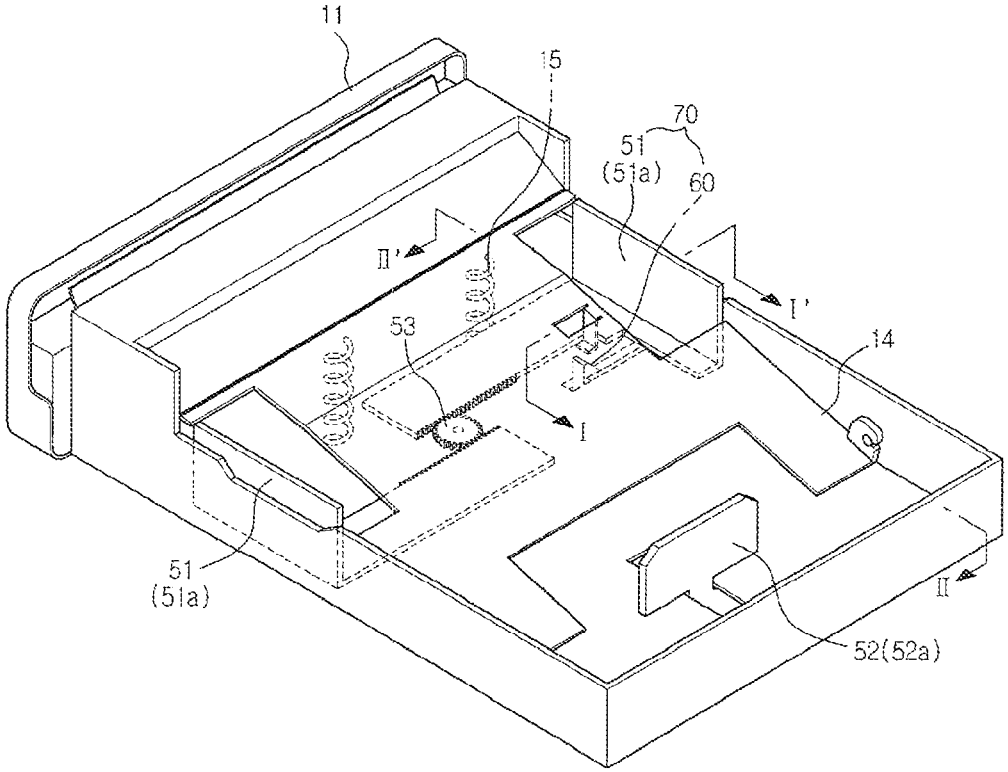
FIG. 2 is a perspective view illustrating a paper supply cassette according to an embodiment.
Figure 3:
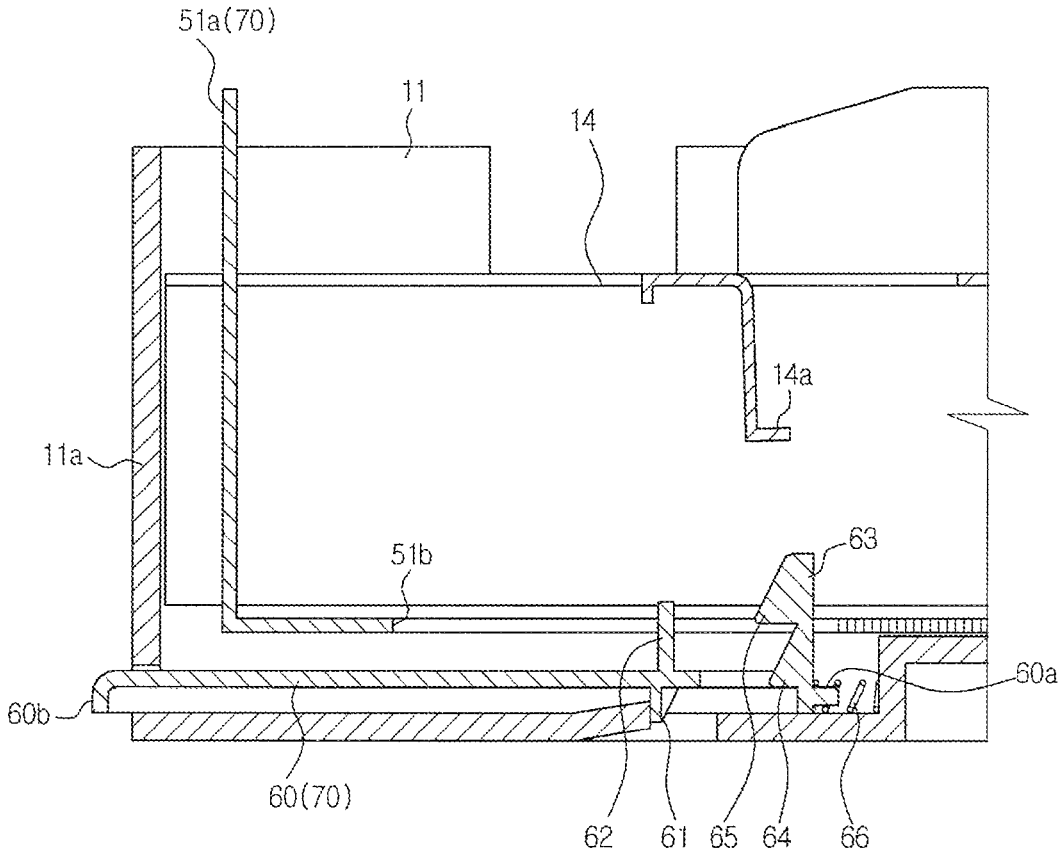
FIG. 3 is a sectional view taken along the line I-I' of FIG. 2.
Figure 4:
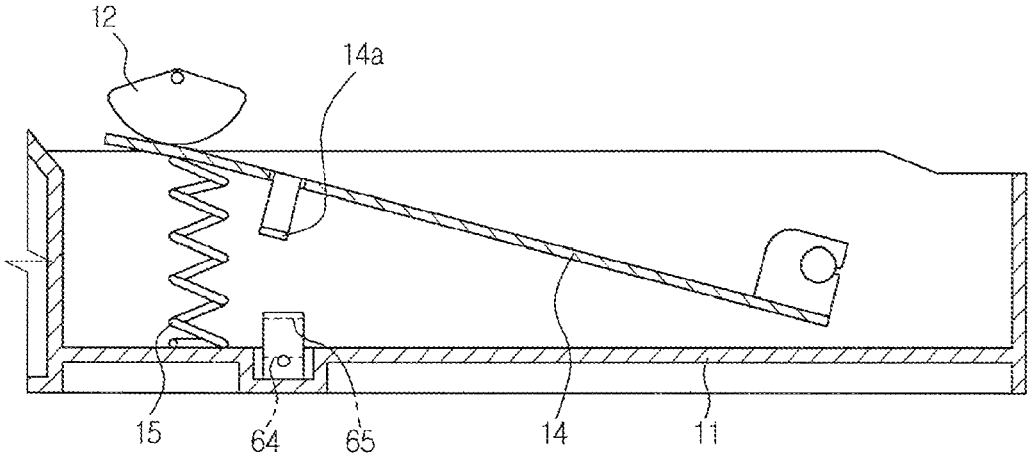
FIG. 4 is a sectional view taken along the line II-II' of FIG. 2.

FIG. 2 is a perspective view illustrating a paper supply cassette according to an embodiment. FIG. 3 is a sectional view taken along the line I-I' of FIG. 2. FIG. 4 is a sectional view taken along the line II-II' of FIG. 2.

As shown in FIGS. 1 through 4, the paper supply cassette 11 according to an embodiment can be provided with a paper loading plate 14 on which the paper can be loaded and at least one elastic member 15, such as a spring, for example, configured to elastically support the paper loading plate 14. The paper loading plate 14 can be pivotally mounted in the paper supply cassette 11. Each elastic member 15 can elastically bias the paper loading plate 14 in an upward direction. With the elastic bias provided by the elastic member 15, the paper loaded on the paper loading plate 14 can be brought into contact with the pickup roller 12. The elastic member 15 can be configured to maintain a constant pressure between the paper and the pickup roller 12 that allow the pickup roller 12 to deliver the paper out of the paper supply cassette 11 one sheet of paper at a time.

The paper supply cassette 11 can include guide units 51 and 52 configured to provide paper alignment. The guide units 51 and 52 can be movably installed, and can be adjusted based on the size of the paper loaded on the paper loading plate 14. In one embodiment, a user can move the guide units 51 and 52 based on the size of paper to be stored in the paper supply cassette 11 prior to loading the paper on the paper loading plate 14.

The guide units 51 and 52 can include first guide members 51 a and a second guide member 52*a*. The first guide members 51*a* can be respectively arranged at both sides of the paper supply cassette 11, and can be linked to each other via engagement with a gear 53. The second guide member 52*a* can be installed through the bottom of the paper supply cassette 11. The first guide members 51*a* can be configured to align left and right edges of the paper loaded on the paper loading plate 14. The second guide member 52*a* can be configured to align front and rear edges of the paper loaded on the paper loading plate 14.

For example, in the case of A4-paper, which has a relatively large size, the first guide members 51 a can be moved to increase the width (i.e., left-to-right distance) of the paper loading space while the second guide member 52*a* can be moved to increase the length (i.e., front-to-rear distance) of the paper loading space. In another example, in the case of A5 paper, which has a relatively small size, the first guide members 51 a can be moved to decrease the width of the paper loading space and the second guide member 52*a* can be moved to decrease the length of the paper loading space. Accordingly, various size paper may be loaded and aligned on the paper loading plate by adjusting the first guide members 51 a and the second guide member 52*a*.

As described above, the elastic member 15 can elastically bias the paper loading plate 14 in an upward direction. More specifically, the elastic member 15 can maintain a substantially constant pressure between the paper loaded on the paper loading plate 14 and the pickup roller 12. Generally, the elastic member 15 can be configured by taking into consideration the type (e.g., size) of paper more frequently loaded on the paper loading plate 14.

For example, when paper that is smaller than the more frequently used paper is loaded on the paper loading plate 14, there is a possibility of variation of the pressure between the paper and the pickup roller 12. The pressure variation can depend on the amount of paper loaded on the paper loading plate 14. More specifically, when a small amount of paper is loaded on the paper loading plate 14, because the elastic member 15 may have a slight spring compression, and because the paper can have a slight weight variation, the pressure between the paper and the pickup roller 12 can be maintained substantially constant. When, however, a large amount of paper is loaded on the paper loading plate 14, because of the more substantial spring compression in the elastic member 15 and the wider weight variation in the paper, the pressure between the paper and the pickup roller 12 can vary. This pressure variation may cause poor paper supply conditions such as the possibility of paper double feeding, i.e., multiple sheets of paper being simultaneously.

To address the above-described situation, the paper supply cassette 11 can be provided with a capacity adjusting unit 70 configured to vary the amount of paper that can be loaded on the paper loading plate 14 based on the size of the paper that is being loaded. For example, the capacity adjusting unit 70 can determine the respective different paper loading capacities when paper of a size frequently used is loaded on the paper loading plate 14 and when paper that is smaller or larger than the frequently used paper is loaded on the paper loading plate 14.

Figure 5:
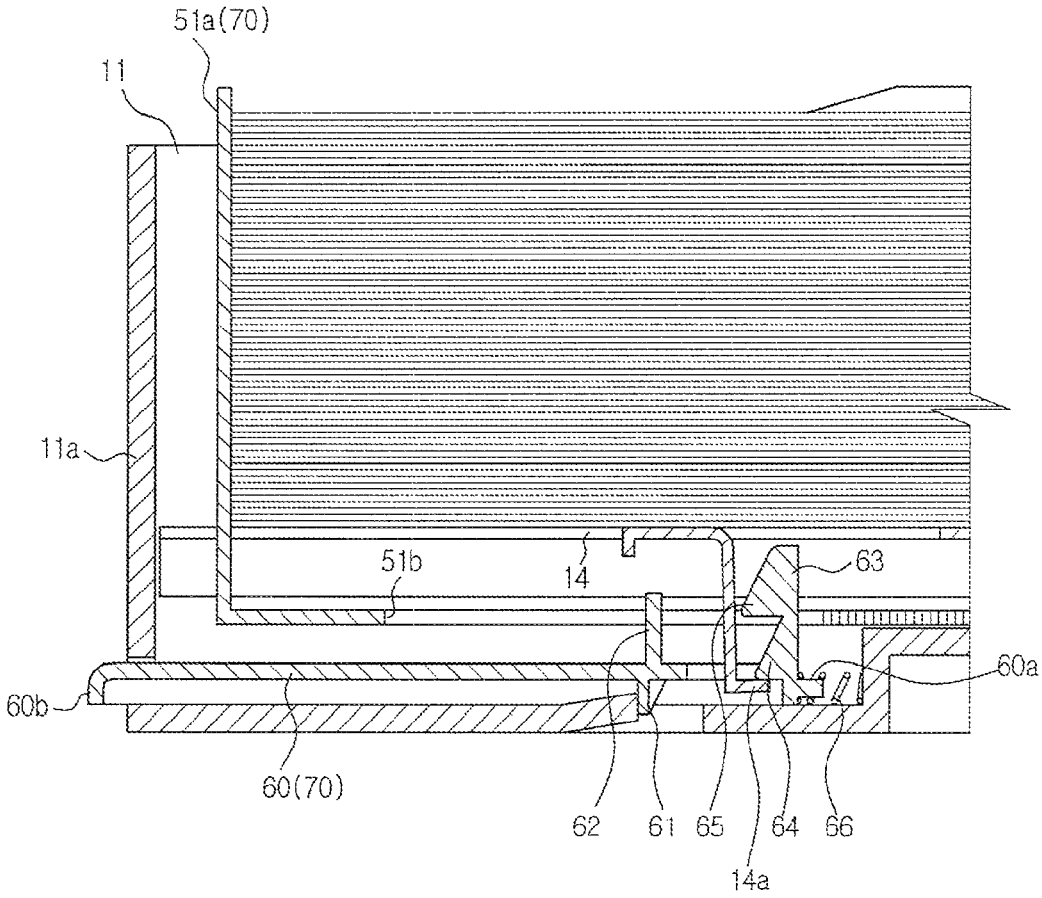
FIGS. 5 and 6 are views illustrating a state wherein a paper loading plate is caught by a first restrainer according to an embodiment.
Figure 6:
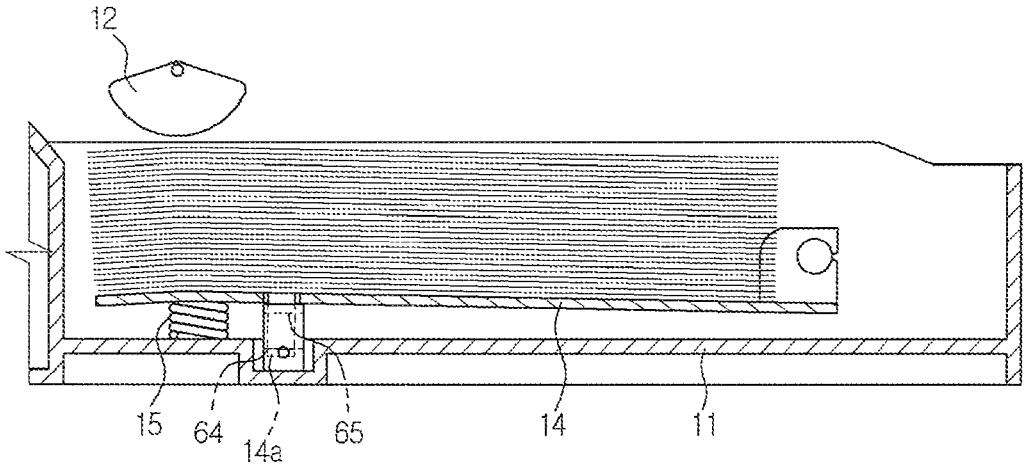
Figure 7:
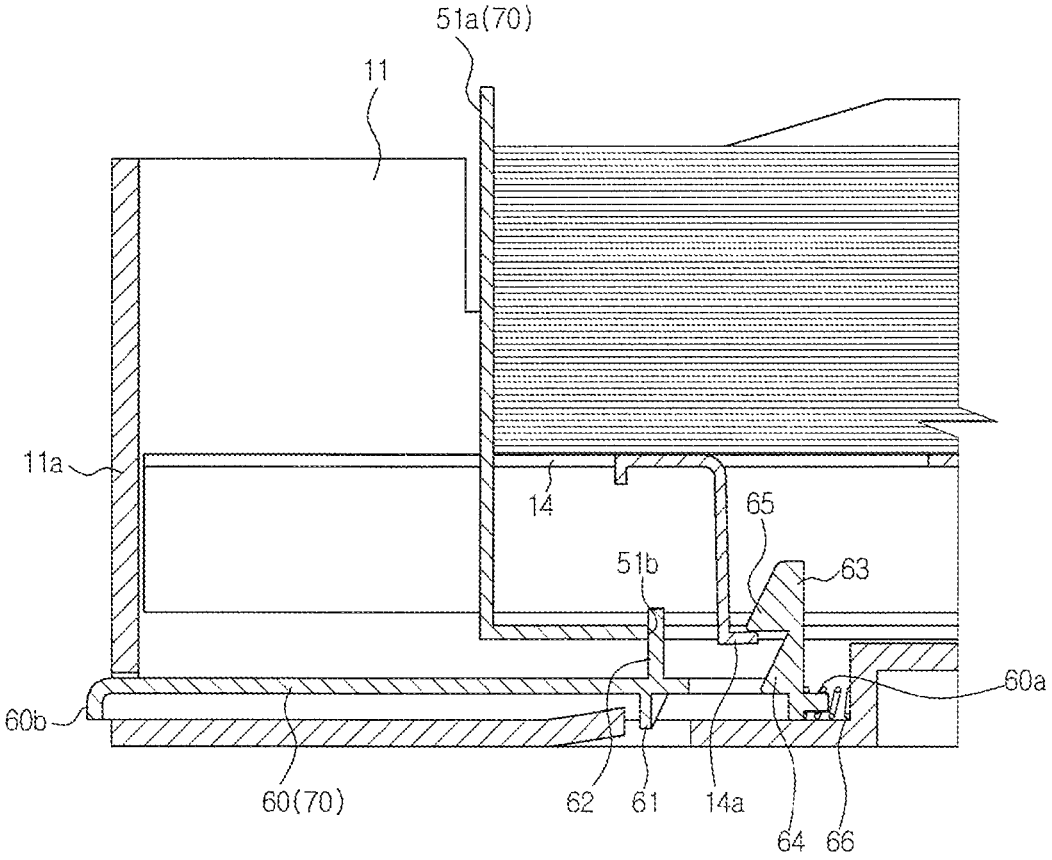
FIGS. 7 and 8 are views illustrating a state wherein the paper loading plate is caught by a second restrainer according to an embodiment.
Figure 8:
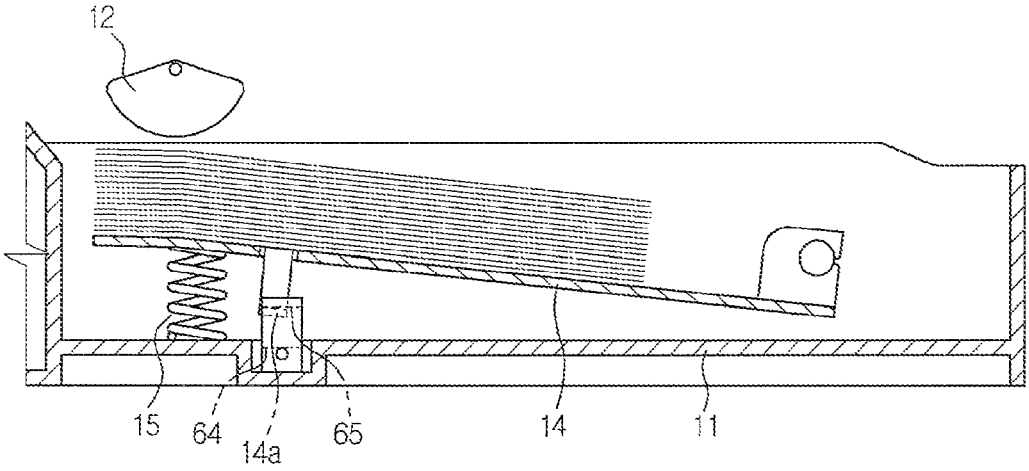

FIGS. 5 and 6 are views illustrating an example of the paper loading plate being caught by a first restrainer according to an embodiment, and FIGS. 7 and 8 are views illustrating an example of the paper loading plate being caught by a second restrainer according to an embodiment.

As shown with respect to at least some of FIGS. 1-8, the capacity adjusting unit 70 can include a locking member 60 and the first guide member 51*a*.

As described above, the first guide member 51 a can be movably mounted in the paper supply cassette 11, and can be used to adjust the width of the paper loading space.

The locking member 60 can be movably mounted to the paper supply cassette 11 such that an end 60*a* of the locking member 60 can be elastically supported by a spring 66. The spring 66 can be configured to elastically bias the locking member 60 in a direction toward a sidewall 11*a* of the paper supply cassette 11. In this example, a stopper 61 of the locking member 60 can be caught by the paper supply cassette 11, whereby a first restricted position of the locking member 60 can be determined (see FIGS. 5 and 6).

The locking member 60 can be linked with the first guide member 51*a*. The locking member 60 can include an operating rib 62 configured as an extension or protrusion that can interact with the first guide member 51*a*, and the first guide member 51*a* can include a press portion 51*b* configured to press the operating rib 62 of the locking member 60. With movement of the first guide member 51*a*, the press portion 51*b* can press on the operating rib 62, causing the locking member 60 to be moved together with the first guide member 51 a by a predetermined distance. Thereafter, when the first guide member 51*a* stops, the operating rib 62 can be caught by the press portion 51*b* despite the spring 66 elastically biasing the locking member 60 toward the sidewall 11*a* of the paper supply cassette 11. Thereby, a second restricted position of the locking member 60 can be determined (see FIGS. 7 and 8).

The locking member 60 can restrict the paper loading plate 14 or can release the restriction. The locking member 60 can include multiple restrainers 63. FIGS. 3-8 illustrate the restrainers 63, each of which can include a first restrainer 64 and a second restrainer 65 stepped from each other. In the embodiments shown with respect to FIGS. 3-8, the second restrainer 65 can protrude more than the first restrainer 64. In other embodiments, however, the configuration of the restrainers 63 can vary from than shown in FIGS. 3-8.

When the paper loading plate 14 is pivoted in a downward direction, a holder 14*a* of the paper loading plate 14 can be caught or engages with any one of the restrainers 63. As a result, the locking member 60 can prevent the paper loading plate 14 from being pivoted in an upward direction, and can determine a loading or restricted position of the paper loading plate 14. As shown in FIGS. 5 and 6, the holder 14*a* of the paper loading plate 14 can be held by the first restrictor 64 in the first restricted position of the locking member 60 thus determining a first loading position of the paper loading plate 14. As shown in FIGS. 7 and 8, the holder 14*a* of the paper loading plate 14 can be held by the second restrictor 65 in the second restricted position of the locking member 60 thus determining a second loading position of the paper loading plate 14.

An end 60*b* of the locking member 60, which is opposite to the end 60*a* supporting the elastic member 66, can protrude outward of the sidewall 11*a* of the paper supply cassette 11. When the paper supply cassette 11 is mounted on the body 1, the body 1 can come into a pressing contact with the end 60*b* of the locking member 60 to cause the movement of the locking member 60 by a predetermined distance. In this example, the holder 14*a* of the paper loading plate 14 can be released from the restrainers 63, whereby the paper loading plate 14 can pivot in an upward direction, and can be elastically biased in that direction by the elastic member 15.

Hereinafter, operation of the image forming apparatus according to an embodiment is described in detail with reference to FIGS. 1-8.

In the image forming apparatus according to the above-described embodiments, the paper supply cassette 11 can be separated from the body 1 to store paper in the paper supply cassette 11. In this example, for convenience, the type of paper that is most typically (e.g., most frequently) used is taken to be the A4 paper, and a type of paper that is smaller than the typically used paper is taken as the A5 paper.

When it is desired to store A4 paper in the paper supply cassette 11, the first guide members 51*a* can be moved to increase the width of the paper loading space and the second guide member 52*a* can be moved to increase the length of the paper loading space. In this example, the locking member 60 can be located in the first restricted position by the stopper 61. When the paper loading plate 14 is pivoted downward, the paper loading plate 14 can be restricted by the first restrainer 64 to thereby be located in the first loading or restricted position (see FIGS. 5 and 6). In this way, A4 paper can be loaded into the paper loading plate 14 while the paper loading plate 14 is in the first loading position. When the paper supply cassette 11 is mounted on the body 1, the paper loading plate 14 can be released from the first restrainer 64 of the locking member 60 and the elastic member 15 can elastically bias the paper loading plate 14 in the upward direction to maintain a constant pressure between the paper and the pickup roller 12. Accordingly, the pickup roller 12 can deliver paper from the paper supply cassette 11 into the body 1 one sheet at a time.

When it is desired to store A5 paper in the paper supply cassette 11, the first guide members 51 a can be moved to decrease the width of the paper loading space and the second guide member 52*a* can be moved to decrease the length of the paper loading space. In this example, the locking member 60 can be in the second restricted position by the operating rib 62. When the paper loading plate 14 is pivoted in the downward direction, the paper loading plate 14 can be restricted by the second restrainer 65 to thereby be located in the second loading position (see FIGS. 7 and 8). In this way, A5 paper can be loaded into the paper loading plate 14 while the paper loading plate 14 is in the second loading position. In this example, a loading capacity of A5 paper is smaller than that of A4 paper loaded on the paper loading plate 14 kept in the first loading position. As the paper supply cassette 11 is mounted on the body 1, the paper loading plate 14 can be released from the second restrainer 65 of the locking member 60 and the elastic member 15 can elastically bias the paper loading plate 14 in the upward direction to maintain a constant pressure between the paper and the pickup roller 12. Accordingly, the pickup roller 12 can deliver paper from the paper supply cassette 11 into the body 1 one sheet at a time.

Figure 9:
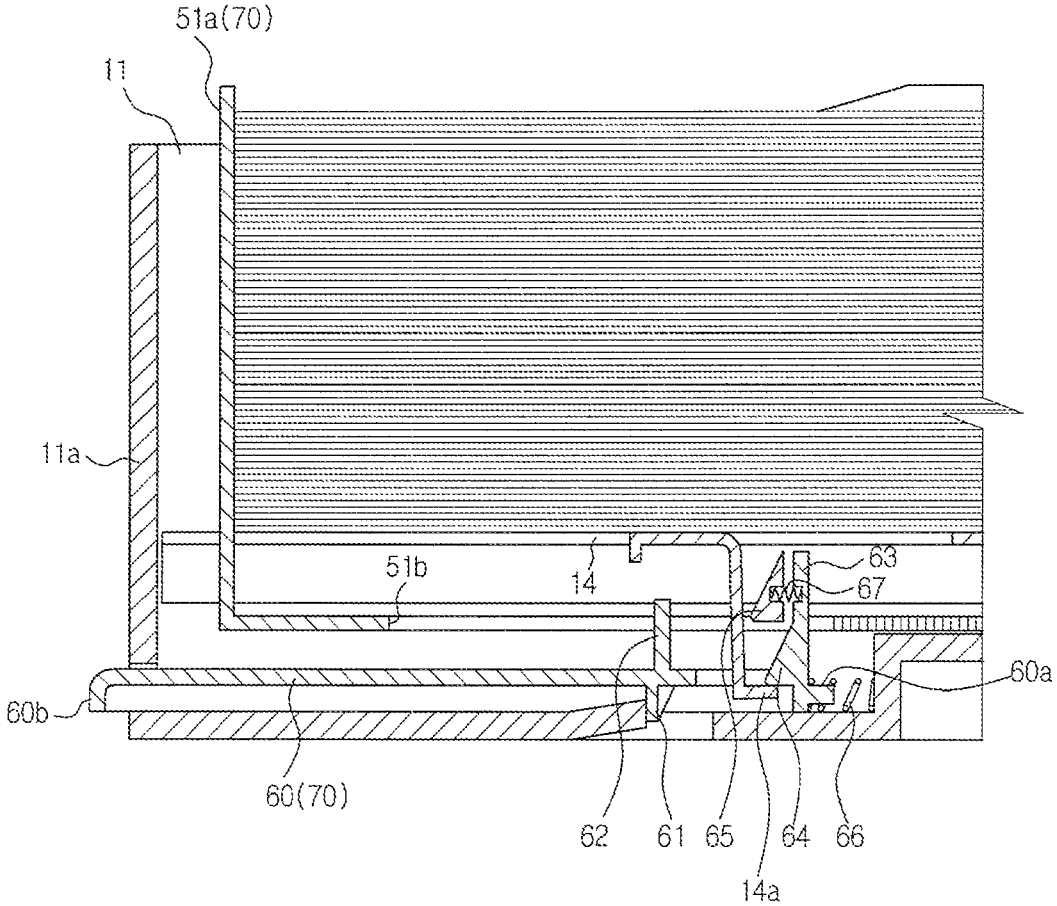
FIG. 9 is a view illustrating a locking member according to an embodiment.

FIG. 9 is a view illustrating a locking member according to another embodiment.

As shown in FIG. 9, the locking member 60 according to an embodiment can include restrainers 63 having the first restrainer 64 and the second restrainer 65 stepped from each other. In this example, the second restrainer 65 can protrude more than the first restrainer 64.

A difference from the previously described embodiments is that the second restrainer 65 can be movable, and can be elastically supported by an elastic member 67 (e.g., a spring). When the locking member 60 is in the first restricted position as shown in FIGS. 5 and 6, the second restrainer 65, which protrudes or extends more than the first restrainer 64, can interfere with the holder 14*a*. With the configuration of the second restrainer 65 as shown in FIG. 9, when the interfering contact between the holder 14*a* and the second restrainer 65 occurs, the elastic member 67 can be compressed and thus the second restrainer 65 can be moved. This configuration can prevent possible noise and/or wear that can occur as a result of the interference between the holder 14*a* and the second restrainer 65.

As is apparent from the above description, in an image forming apparatus according to the various embodiments, a loading capacity of paper can be optimized based on a paper size, achieving an optimal paper supply environment.

Moreover, it may be possible to prevent certain occurrences, such as paper double feeding and/or paper jam, for example, which can be caused when a paper loading capacity exceeds an appropriate loading capacity.

In addition, the image forming apparatus can prevent noise and/or wear, resulting in enhanced product reliability.

Although several embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An image forming apparatus, comprising:

a body having an opening; and a printing media cassette receivable into the body through the opening, the printing media cassette comprising:

a printing media loading plate having a surface on which to support printing media received in the printing media cassette, the printing media loading plate being configured to move into varying positions so as to define varying amounts of the printing media that can be received in the printing media cassette; and a capacity adjustment unit configured to restrict a movement of the printing media loading plate to define at least two locked loading positions of the printing media loading plate, the at least two loading positions of the printing media loading plate being two of the varying positions selected based on a size of the printing media being received in the printing media cassette, wherein the capacity adjustment unit comprises:

a guide member movable to define an area on the surface of the printing media loading plate variably based on the size of the printing media being received in the printing media cassette; and a locking member configured to move in association with the guide member to thereby hold the printing media loading plate at the selected loading position, the locking member including a stopper to come into a contact with a portion of the printing media cassette body when the printing media loading plate is positioned at a first locked loading position of the varying positions, and an operating rib extending from the locking member to come into a contact with a portion of the guide member when the printing media loading plate is positioned at a second locked loading position of the varying positions.

2. The image forming apparatus according to claim 1, wherein the locking member includes a plurality of restrainers, and wherein the printing media loading plate includes a holder configured to engage with a select one of the plurality of restrainers based on the size of the printing media.

3. The image forming apparatus according to claim 2, wherein the plurality of restrainers include a first restrainer and a second restrainer spaced apart from each other.

4. The image forming apparatus according to claim 3, wherein the first and second restrainers each comprises a protrusion extending from the locking member toward the holder of the printing media loading plate, one of the first and second restrainers protruding further than the other.

5. The image forming apparatus according to claim 3, wherein one of the first and second restrainers that protrudes further is movably and elastically supported on the locking member.

6. The image forming apparatus according to claim 1, wherein the printing media cassette further comprises:

an elastic member arranged to elastically bias the locking member toward a first direction.

7. The image forming apparatus according to claim 6, wherein the locking member further comprises an end portion configured to come into a pressing contact with a portion of the body when the printing media cassette is received in the body, the pressing contact between the end portion of the locking member and the portion of the body causing the locking member to move in a second direction opposite the first direction.

8. The image forming apparatus according to claim 6, wherein the guide member includes a press portion configured to come into a pressing contact with the operating rib of the locking member so as to cause the locking member to move in a second direction opposite the first direction from the first position to a second position at which the locking member holds the printing media loading plate at a second one of varying positions as the selected loading position.

9. The image forming apparatus according to claim 8, wherein the press portion of the guide member is configured to come into the pressing contact with the operating rib selectively based on the size of the printing media.

10. The image forming apparatus according to claim 1, further comprising an elastic member to elastically bias the printing media loading plate in an upward direction.

11. A printing media cassette for receiving therein printing media for use by an image forming apparatus, comprising:

a printing media loading plate having a surface on which to support the printing media received in the printing media cassette, the printing media loading plate being configured to move between at least a first locked loading position and a second locked loading position to define a first loading capacity and a second loading capacity, respectively, of the printing media that can be received in the printing media cassette;

a guide member movable between at least a first guide position and a second guide position at which to guide movement of printing media of a first size and printing media of a second size, respectively; and a locking member moveable in association with the guide member such that the locking member causes the printing media loading plate to be in the first locked loading position when the guide member is in the first guide position and to be in the second locked loading position when the guide member is in the second guide position, wherein the locking member includes:

a stopper to come into a contact with a portion of the printing media cassette body when the printing media loading plate positioned at the first locked loading position, and an operating rib extending from the locking member to come into a contact with a portion of the guide member when the printing media loading plate is positioned at the second locked loading position.

12. The printing media cassette of claim 11, wherein the first size comprises an A-4 size, the second size comprising an A-5 size, the first loading capacity being greater than the second loading capacity.

13. The printing media cassette of claim 11, wherein the first size comprises a Letter size, the second size comprising an A-5 size, the first loading capacity being greater than the second loading capacity.

14. The printing media cassette of claim 11, wherein the locking member comprises; first and second protrusions, one protruding further than the other, wherein the printing media loading plate has a holder member extending from the surface of the printing media loading plate toward the first and second protrusions of the locking member so as to selectively engage one of the first and second protrusions, and wherein the guide member comprises a press portion that is arranged to come onto pressing contact with the locking member to thereby cause the locking member to move in a first direction between a first locking position at which the holder member of the printing media loading plate is engaged with the first protrusion of the locking member and a second locking position at which the holder member of the printing media loading plate is engaged with the second protrusion of the locking member.

15. The printing media cassette of claim 14, further comprising:

an elastic member disposed in contact with the locking member and elastically biasing the locking member toward a second direction opposite the first direction.

16. The printing media cassette of claim 15, further comprising:

a cassette body supporting thereon each of the printing media loading plate and the locking member.

17. The printing media cassette of claim 16, wherein the locking member further comprises: an end portion that protrudes out of the cassette body and, when pressed, the end portion causes the locking member to move in the first direction so as to be retracted into the cassette body.

* * * * *